US008226279B2

(12) United States Patent
Harnischmacher et al.

(10) Patent No.: US 8,226,279 B2
(45) Date of Patent: Jul. 24, 2012

(54) LIGHTING FIXTURE AND RAIL MODULE

(75) Inventors: Friedhelm Harnischmacher, Menden (DE); Renate Hoffmann, Dortmund (DE); Jens Burmeister, Eberbach (DE); Gerhard Schwarz, Schönbrunn (DE); Heinz Rudolf Liedtke, Dortmund (DE)

(73) Assignee: Cooper Crouse-Hinds GmbH, Soest (DE)

( * ) Notice: Subject to any disclaimer, the term of this patent is extended or adjusted under 35 U.S.C. 154(b) by 129 days.

(21) Appl. No.: 12/601,305

(22) PCT Filed: Feb. 22, 2008

(86) PCT No.: PCT/EP2008/001418
§ 371 (c)(1), (2), (4) Date: Jun. 14, 2010

(87) PCT Pub. No.: WO2008/145204
PCT Pub. Date: Dec. 4, 2008

(65) Prior Publication Data

US 2010/0271812 A1 Oct. 28, 2010

(30) Foreign Application Priority Data

May 25, 2007 (DE) ..... 10 2007 024 422

(51) Int. Cl.
*F21V 23/06* (2006.01)

(52) U.S. Cl. ..... 362/368; 362/147

(58) Field of Classification Search ..... 362/147, 362/648, 249.07, 368
See application file for complete search history.

(56) References Cited

U.S. PATENT DOCUMENTS

| | | | | |
|---|---|---|---|---|
| 4,646,211 | A * | 2/1987 | Gallant et al. | 362/149 |
| 6,716,042 | B2 * | 4/2004 | Lin | 362/147 |
| 2003/0031018 | A1 * | 2/2003 | Bray et al. | 362/391 |

FOREIGN PATENT DOCUMENTS

| | | |
|---|---|---|
| DE | 3633351 | 4/1988 |
| EP | 0392136 | 10/1990 |
| EP | 0486714 | 5/1992 |
| EP | 1349437 | 10/2003 |

OTHER PUBLICATIONS

Prevot, Eric, Written Opinion of the International Searching Authority for PCT/EP2008/001418, pp. 1-11.

* cited by examiner

*Primary Examiner* — David V Bruce
(74) *Attorney, Agent, or Firm* — King & Spalding LLP

(57) ABSTRACT

The invention relates to a lighting fixture (1) which comprises at least one lighting fixture housing (2) and a cover (3) and which is constructed particularly as a safety and/or emergency exit light and/or as an explosion-proof light. A light is held by a clamp connection (5) at the lighting fixture housing, and at least one auxiliary electrical device (6) into the light is disposed at the lighting fixture housing. The lighting fixture can be expanded with a lower expense for the installation and with all explosion-protection measures observed, by virtue of the lighting fixture housing (2) having conductor rails (7) for supplying electricity to the light and to the auxiliary electrical device, where the auxiliary electrical device is constructed as a plug-in module which can be plugged onto the conductor rails.

16 Claims, 1 Drawing Sheet

LIGHTING FIXTURE AND RAIL MODULE

Figure 1:
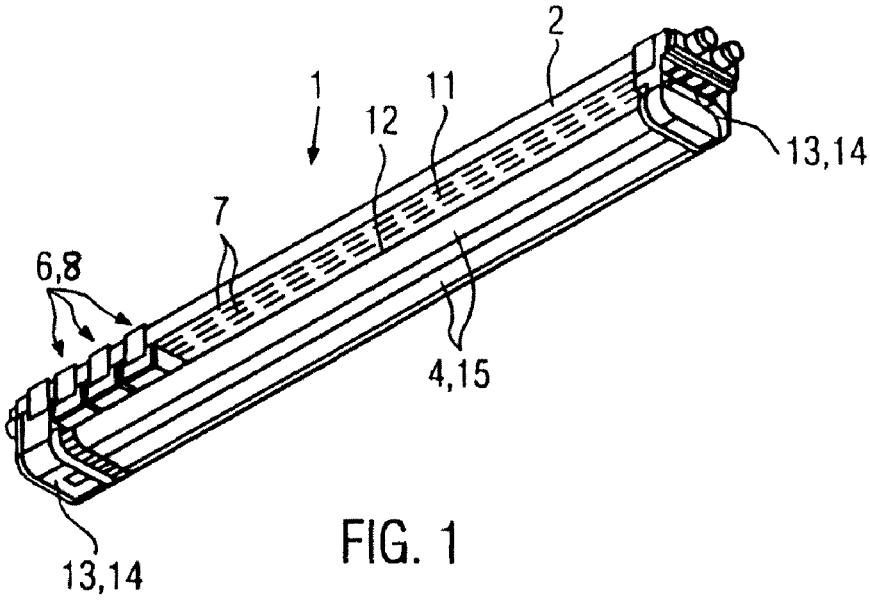

A plurality of lighting fixtures are known from practice, which are comprised of a lighting fixture housing and a cover. The lighting fixture comprises a corresponding illuminating means which is held on the housing by means of clamp connections. Such lighting fixtures may particularly be safety/emergency exit lights and/or explosion-proof lights. The lighting fixture housing may comprise or be connectable to a wall bracket, a ceiling pendulum, a chain suspension or the like. Moreover, the lighting fixture housing may also be installed in the ceiling or in the wall and may also be realized, for example, as a linear fluorescent luminary.

As a rule, the lighting fixture comprises a corresponding auxiliary electrical device for the illuminating means, which is also arranged on the housing. Such an auxiliary device is, for example in the case of a linear fluorescent luminary, an electronic ballast. Moreover, lighting fixtures are known that are provided with a monitoring device as auxiliary device, for example, to allow the monitoring of the condition of the lighting fixture or the illuminating means from a remote place.

The arrangement of the corresponding auxiliary electrical device on the lighting fixture housing normally requires a corresponding wiring, which increases the installation work, the production costs or also the space requirements. Moreover, such wirings partly require additional measures in view of explosion protection.

Inside explosion-hazardous areas lighting fixture housings and covers are connected to each other by corresponding sealing means so as to guarantee explosion protection.

The invention is based on the object to improve a lighting fixture of the above-described type in order to allow with little installation and time expenditure and in a cost-effective way, and by taking into account any explosion protection measures, a simple extensibility and a simplified structure of the lighting fixture.

This object is achieved with the features of patent claim 1.

According to the invention the lighting fixture is characterized in that the housing comprises conductor rails for the electrical supply of illuminating means and auxiliary electrical devices, wherein the auxiliary electrical device is designed as a plug-in module to be plugged onto the conductor rails. By simply plugging the plug-in module onto the conductor rails at least the electrical contact to the power supply is realized. The actual detachable engagement or the like may be accomplished by other parts of the lighting fixture housing. This means that the actual plugging the plug-in module onto the conductor rails can simultaneously serve the attachment of the plug-in module. However, there may also be provided other devices on the housing and on the plug-in module, which are detachably engaged with each other when the plug-in module is plugged onto the conductor rails.

In a simple manner, the conductor rails may also be used for plugging additional plug-in modules onto the same. The number and the arrangement of the plug-in modules depend substantially on the length and the arrangement of the conductor rails. Also, it is possible that the position of the corresponding plug-in module is not a fixed one, but that, for example, different plug-in modules can also be arranged in different orders, with their function being independent of this arrangement.

To have sufficient space available for several plug-in modules, the conductor rails may extend in the longitudinal direction of the lighting fixture housing. Thus, substantially the total length of the lighting fixture housing is usable for the arrangement of corresponding plug-in modules.

To be able to easily find out, for example, if a lighting fixture housing is mounted on a wall or a ceiling, which plug-in modules are already provided or are still to be provided, the conductor rails may be arranged on a surface of the lighting fixture housing that points to the illuminating means. This simplifies, on the one hand, the corresponding plug-on step of plug-in modules if the lighting fixture housing is already fixed and, on the other hand, the plug-in modules are well visible if the illuminating means is mounted. The corresponding plug-in modules may be marked with regard to their function by different colors or other means.

In this connection it is likewise possible that the plug-in modules are displaceable along the conductor rails so as to allow the arrangement of another one, for example, between two plug-in modules.

A simple realization of the corresponding lighting fixture housing may be seen in its realization as a backplane at least in the region of the conductor rails. Such a backplane substantially designates a bus board or back panel, which may be provided with several slots for plug-in units. Also, corresponding plug-type connectors for the plug-in units may be arranged on the backplane, which not only serve holding purposes, but also the electrical connection. With such a backplane the conductor rails may also be limited to sections in which a plug-in module can be arranged in the corresponding plug-type connector. This means that the conductor rail is substantially formed by the corresponding plug-type connectors of the backplane. The plug-in modules may, in this connection, also be realized as plug-in boards known per se.

If the various plug-in modules are to communicate with each other or also with a superior unit, at least one data bus may be provided in addition to the conductor rails, through which the different plug-in modules may be addressable and controllable. The communication can, in this connection, also be bi-directional.

To simplify also the mounting of an electrical supply of the illuminating means the clamp connection may be realized as a connector plug-in module. This means that the corresponding clamps for the illuminating means, too, are realized as plug-in modules and that also conductor rails and data buses can be plugged on at a respective distance and are variable with respect to their distance, if necessary.

As an input for electrical supply lines has to be provided on at least one place of the lighting fixture, the lighting fixture may also comprise a corresponding plug-in module for connecting such supply lines. In a simple embodiment the connector plug-in module may here by realized as an input closing module which serves the connection of corresponding electrical supply/data lines on the part of the lighting fixture. If several lighting fixtures are connected in series, such an input closing module may be provided substantially on both ends of the lighting fixture.

In order to simplify also the arrangement specifically in the case of several individual lighting fixtures the illuminating means may be realized as a lamp module. Thus, for example, two or more fluorescent lamps or the like can be handled, wherein, for correspondingly inserting all illuminating means, the corresponding lamp module is inserted.

The different auxiliary electrical devices may all be realized as corresponding plug-in modules. This means that, for example, a ballast module, a monitoring module, a battery module or the like can be used. The ballast modules may contain different electrical ballasts, depending on the requirements. The monitoring modules serve, on the one hand, the monitoring and detection of parameters of the lighting fixture, for example, for detecting a failure or the like. Moreover, such monitoring modules also serve the realization of different supply and monitoring systems. For example, the monitoring module may also be used for switching between permanent light, standby light or switched permanent light, as well as for monitoring such a light.

The corresponding connector plug-in module can, in this connection, serve both the electrical and data supply of the corresponding rail/bus. This means that the corresponding rails/buses extend up to the connector plug-in module, where they are supplied with electrical power or with data.

The transmission of the data and also of the electrical supply to a subsequent lighting fixture can be accomplished by a second connector plug-in module substantially at the other end of the corresponding lighting fixture via lines or the like.

In order to allow an easy control of each plug-in module for a communication a plug-in module may be associated with a control device which is, as a rule, integrated in the plug-in module and serves, for example, the addressing of the plug-in module and the controlling or picking off, respectively, or transmitting corresponding data through the data bus.

The invention also relates to a rail module for a lighting fixture, wherein the rail module forms at least a part of a lighting fixture housing and comprises at least conductor rails for the electrical supply of plug-in modules as auxiliary electrical devices of the lighting fixture, which can be plugged onto the conductor rails. Such a rail module may be retrofitted to a lighting fixture so as to allow a conversion of an otherwise usual lighting fixture into a lighting fixture comprising a rail module and pluggable plug-in modules.

With such a rail module, too, it may be an advantage if at least one data bus is provided in addition to the conductor rails.

The corresponding rail module may be realized as a retrofit module so as to connect it to the already existing lighting fixture housing of a lighting fixture in an easy fashion. Also, it is possible that the rail module already forms the corresponding lighting fixture housing, on which a correspondingly transparent cover can be mounted so as to complete the lighting fixture. Thus, an existing lighting fixture housing is replaced by the rail module.

It is likewise possible that such a rail module can be assembled from rail module segments. This allows an easier adaptation to different conditions and especially to different lengths of an illuminating means.

The invention will be explained in more detail below by means of the figures illustrated in the drawing.

Figure 2:
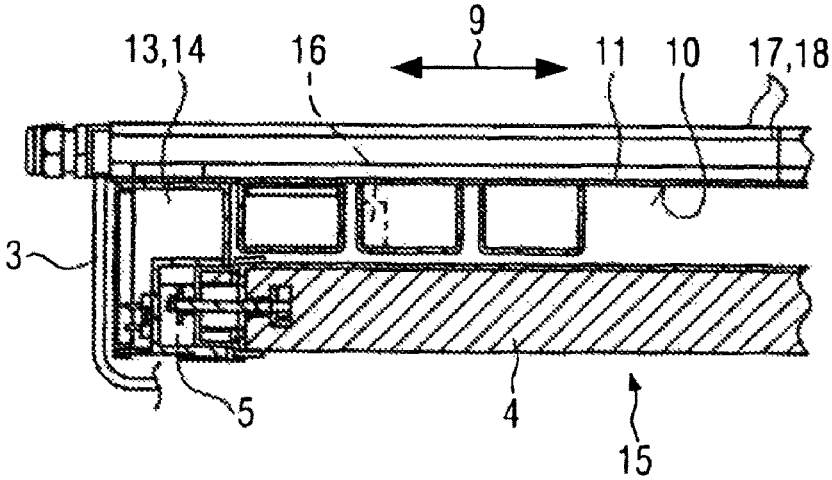

In the drawing:

FIG. 1 shows a perspective oblique top view from below onto a lighting fixture according to the invention with the cover removed, and FIG. 2 shows a section along a longitudinal direction of the lighting fixture according to FIG. 1.

FIG. 1 shows a perspective view from a low oblique view point onto a lighting fixture 1 according to the invention. This lighting fixture comprises a lighting fixture housing 2 and a cover 3, which is only illustrated in part in FIG. 2. The lighting fixture housing 2 and the cover 3 are connected by corresponding sealing means to obtain an explosion-proof lighting fixture or at least a safety or emergency exit light. In FIG. 1 a corresponding linear fluorescent luminary is illustrated. It comprises two fluorescent lamps as illuminating means 4, which are arranged parallel to each other and which form a lamp module 15, also see FIG. 2. The lamp module is laterally inserted with one end, see FIG. 2, into a connector plug-in module 13 and with the other end, also see FIG. 1, into another connector plug-in module 13 from below, wherein the connector plug-in modules define clamp connections.

The lighting fixture housing 2 extends substantially parallel with respect to the lamp module 15 and serves, for example, the mounting on a ceiling or a wall. It is also possible, however, that a wall bracket, a ceiling pendulum, a chain suspension or the like is provided in addition to the lighting fixture housing. Moreover, it is possible that the lighting fixture housing 2 serves the installation in a corresponding cavity on a ceiling or wall.

On a surface 10 of the lighting fixture housing 2, which points to the illuminating means 4, also see FIG. 2, at least two conductor rails 7 and one data bus 12 are arranged. The conductor rails 7 serve the electrical supply both of the connector plug-in modules 13 and other auxiliary electrical devices. These auxiliary electrical devices 6 are likewise realized as plug-in modules 8. Such auxiliary electrical devices 6 are, for example, an electronic ballast module, a monitoring module, a battery module, a charging module or the like. The corresponding plug-in modules are displaceably arranged along the conductor rails and data buses 7, 12 in the longitudinal direction 9 of the lighting fixture housing 2. For fixing the plug-in modules corresponding devices may be provided directly on the lighting fixture housing 2 and on the plug-in modules or for the snap-on engagement thereof, respectively.

The lighting fixture housing 2 substantially defines with its surface 10 and the conductor rails and data buses 7, 12 arranged thereon a backplane 11 on which the corresponding plug-in modules 8 are arranged. The connector plug-in modules 13, which may in particular be realized as input closing modules 14, are arranged on this backplane at opposite ends.

The input closing modules 14, see FIG. 2, serve to connect corresponding electrical connection lines which are linked up from a voltage source or an adjacent lighting fixture. In an analogous way, an input closing module 14, see the right-hand side of lighting fixture 1 in FIG. 1, may also serve to extend electrical connection lines to another lighting fixture.

The corresponding plug-in modules 8 may each have a control device 16, see FIG. 2, which allows, for example, the communication through a data bus 12. By means of the control device 16 the different plug-in modules 8 are controllable or also addressable.

For exchanging a corresponding plug-in module 8, as a rule, the lamp module 15 has to be removed first. Then, each plug-in module can be handled separately and can be installed, removed or replaced by another one. On visible exterior sides of the plug-in modules 18, see for example FIG. 1, corresponding markings or identifications may be provided which identify, for example, the type and function of the corresponding plug-in module.

In the lighting fixture according to the invention no wiring is necessary between, for example, the connector plug-in module 13 and the other plug-in modules 8. This reduces the product costing for a corresponding lighting fixture and, at the same time, the time expenditure required for assembling the lighting fixture. Also, it is possible to retrofit a corresponding lighting fixture 1 with additional plug-in modules 8 or, for example, to replace an electronic ballast module by another one, specifically if other illuminating means are used. The corresponding initiation and control of the plug-in modules 8 may be accomplished via the data bus or the data buses 12. This may also be accomplished by a remote central controller, with which, for example, also a corresponding monitoring module as plug-in module 8 of the lighting fixture 1 communicates.

Another object of the invention is a rail module 17, see FIG. 2, which substantially defines the lighting fixture housing 2. As was already described above, such a rail module 17 can comprise corresponding conductor rails and data buses 7, 12 onto which the different plug-in modules 8 and also connector plug-in modules or input closing modules 13, 14 can be plugged. The rail module 17 may be realized with the corresponding plug-in modules 8, depending on the illuminating means used. For the adaptation to an associated length of the illuminating means the corresponding rail module can be assembled from rail module segments 18, see FIG. 2, which may have a certain basic length for one illuminating means and can then be adapted to lengths of other illuminating means by plugging different rail module segments 18 together. The corresponding rails/buses 7, 12 are likewise connected to each other when the rail module segments are plugged together.

Moreover, it be noted that the use of corresponding plug-in modules also permits the easy retrofitting of a lighting fixture which had previously only been used for areas without explosion protection, for example, by substituting the corresponding plug-in modules with those that satisfy the explosion protection criteria.

According to the invention it is possible that, for example, the lamp module 15 is already provided with an own housing, so that no separate cover, see FIG. 2, is necessary. The lamp module 15 is, for example, simply fixed via explosion-proof contacts to the connector plug-in module 13 on one side, see the left-hand side in FIG. 2, while the other end of the lamp module, see FIG. 1, can be fixed to the lighting fixture 1 simply by engagement, insertion into a holder or the like. The corresponding contacting of the illuminating means arranged in the lamp module 15 can, in this connection, only be accomplished via the left end illustrated in FIG. 2.

Another plug-in module is, for example, a radio module which, depending on the case of need, is realized as a Bluetooth radio module, a WLAN radio module or the like. Thus, a wireless transmission of data between the lighting fixture 1 and a non-illustrated central controller, or also an on-site control is possible in an easy manner.

The invention claimed is:

1. A lighting fixture (1) comprising:

at least one lighting fixture housing (2);

a cover (3);

an illuminating means (4);

a clamp connection (5) configured to couple the illuminating means (4) to the at least one lighting fixture housing (2);

at least one conductor rail (7) configured to provide electrical supply;

an auxiliary electrical device (6) configured as a plug-in module (8) that is plugged into the at least one conductor rail (7).

2. The lighting fixture according to claim 1, wherein the at least one conductor rail (7) extends in a longitudinal direction (9).

3. The lighting fixture according to claim 1 or 2, wherein the at least one conductor rail (7) is arranged on a surface (10) of the at least one lighting fixture housing (2) which points to the illuminating means (4).

4. The lighting fixture according to claim 1, wherein the at least one conductor rail (7) is positioned on a backplane (11).

5. The lighting fixture according to claim 4, wherein the backplane (11) comprises at least one data bus (12) in addition to the at least one conductor rail (7).

6. The lighting fixture housing (2) according to claim 5, wherein the connector plug-in module (13) is configured for a data supply of the at least one data bus (12).

7. The lighting fixture according to claim 1, wherein the clamp connection (5) is realized as a connector plug-in module (13).

8. The lighting fixture according to claim 7, wherein the connector plug-in module (13) is realized as an input closing module (14).

9. The lighting fixture according to claim 1, wherein the illuminating means (4) is realized as a lamp module (15).

10. The lighting fixture according to claim 7, wherein the plug-in module (8) is at least one selected from a group consisting of an electronic ballast module, a monitoring module, and a battery module.

11. The lighting fixture according to claim 7, wherein the connector plug-in module (13) is configured for the electrical supply of the at least one conductor rail (7).

12. The lighting fixture according to claim 1, wherein the plug-in module (8) is associated with a control device (16).

13. A rail module (17) for a lighting fixture (1), wherein the rail module forms at least a part of a lighting fixture housing (2) and comprises at least one conductor rail (7) for the electrical supply of one or more plug-in modules (8, 13, 14, 15) as auxiliary electrical devices (6) of the lighting fixture (1), wherein the one or more plug-in modules are plugged into the at least one conductor rail and are arranged along the at least one conductor rail (7) in a longitudinal direction (9).

14. The rail module according to claim 13, further comprising at least one data bus (12).

15. The rail module according to claim 13 or 14, wherein the rail module (17) is realized as a retrofit module.

16. The rail module according to claim 13, wherein the rail module (17) is assembled from rail module segments (18).

* * * * *